US007370839B2

(12) United States Patent
Putman

(10) Patent No.: US 7,370,839 B2
(45) Date of Patent: May 13, 2008

(54) PASS THROUGH SLIDING DRAPERY SUSPENSION SYSTEM

(76) Inventor: Michael Putman, 9435 Jefferson Blvd., Culver City, CA (US) 90232

( * ) Notice: Subject to any disclaimer, the term of this patent is extended or adjusted under 35 U.S.C. 154(b) by 0 days.

(21) Appl. No.: 10/899,334

(22) Filed: Jul. 26, 2004

(65) Prior Publication Data

US 2005/0022950 A1 Feb. 3, 2005

Related U.S. Application Data

(60) Provisional application No. 60/490,673, filed on Jul. 28, 2003.

(51) Int. Cl.
*A47H 1/10* (2006.01)

(52) U.S. Cl. ..... 248/262; 248/261; 248/251

(58) Field of Classification Search ..... 248/262, 248/261, 251, 263, 266, 267, 255, 252, 254, 248/256, 257, 253, 265, 269
See application file for complete search history.

(56) References Cited

U.S. PATENT DOCUMENTS

| | | | | | |
|---|---|---|---|---|---|
| 319,908 | A | * | 6/1885 | Hyde, Jr. | 248/254 |
| 592,846 | A | * | 11/1897 | Warner | 248/254 |
| 596,815 | A | * | 1/1898 | Kullberg | 16/87.4 W |
| 756,361 | A | * | 4/1904 | Hatter | 248/257 |
| 758,419 | A | * | 4/1904 | Cooke | 248/259 |
| 827,272 | A | * | 7/1906 | Tait | 248/265 |
| 928,190 | A | * | 7/1909 | Flynn | 248/263 |
| 953,912 | A | * | 4/1910 | Laun | 248/262 |
| 1,049,355 | A | * | 1/1913 | Haller | 248/262 |
| 1,057,043 | A | * | 3/1913 | Dohm | 248/262 |
| 1,291,249 | A | * | 1/1919 | Taylor | 248/254 |
| 1,354,974 | A | * | 10/1920 | Hunter | 248/254 |
| 1,454,557 | A | * | 5/1923 | Nietzel | 248/256 |
| 1,480,841 | A | * | 1/1924 | Simmons | 248/254 |
| 1,567,744 | A | * | 12/1925 | Mathis | 248/256 |
| 2,320,308 | A | | 5/1943 | Silverman | |
| 2,386,854 | A | * | 10/1945 | Hilton | 248/254 |
| 2,538,755 | A | * | 1/1951 | Bradley | 160/341 |
| 2,741,923 | A | | 4/1956 | Bradley | |
| 3,095,033 | A | * | 6/1963 | Polkosnik | 160/345 |

(Continued)

*Primary Examiner*—Kimberly Wood
(74) *Attorney, Agent, or Firm*—Bruce A. Jagger

(57) ABSTRACT

A drapery mounting system comprised of a drapery rod member, a drapery hanger element, and a support member for the rod. The support member is positioned below and intermediate the respective opposed ends of the drapery rod. The support member includes a saddle, a support arm, and a retainer. The saddle is shaped to support a lower external portion of said drapery rod. The saddle extends laterally of the drapery rod for less than about the cross-sectional width of the rod to permit a drapery hanger to pass unimpeded over the saddle. The saddle element preferably has longitudinally opposed edges disposed along the drapery rod. The longitudinally opposed edges are generally convexly arcuate relative to a longitudinal axis of the drapery rod. The support and retention functions are separated. The saddle supports the rod and the retainer releasably retains the drapery rod in engagement with the saddle. A support arm supports from below the saddle. The drapery hanger is slidably supported on the drapery rod member for substantially unimpeded movement past the support member. The drapery hanger typically has a generally question mark shaped form including a hook portion with an open mouth and a depending leg portion, with the open mouth preferably being of sufficient width to pass the drapery rod member laterally therethrough.

7 Claims, 4 Drawing Sheets

U.S. PATENT DOCUMENTS 3,119,442 A * 1/1964 Ford et al. ..... 160/345
3,157,225 A * 11/1964 Freydberg et al. ..... 160/345
3,342,247 A 9/1967 Graber et al.
3,370,819 A * 2/1968 Kenney ..... 248/265
3,434,685 A * 3/1969 Gorgone ..... 248/263
3,881,218 A 5/1975 Palmer
4,190,927 A 3/1980 Hepperle
4,322,050 A * 3/1982 Roach ..... 248/222.51

* cited by examiner

PASS THROUGH SLIDING DRAPERY SUSPENSION SYSTEM

RELEATED APPLICATION

Applicant claims the benefit of Provisional No. 60/490,673, filed Jul. 28, 2003.

BACKGROUND OF THE INVENTION

1. Field of the Invention

The invention relates in general to methods and devices for pass through sliding drapery mounting systems, and, more particularly, embodiments of the present invention relate to drapery rod mounting systems and associated drapery hangers that permit the hangers to directly engage and slide freely over securely mounted rods.

2. Description of the Prior Art

Conventional support systems for draperies typically include a horizontally extending rod and hangers or hooks that engage the drapery at a lower end and are supported on the rod at an upper end. Typically, the span of the drapes is such that the rod must be supported at its endpoints and in the middle. This mid section support prevents the mid section of the rod from bending downwardly under the weight of the drapes. Typically, the drapes need to be openable to permit light to enter the room. This requires that the hangers be free to move longitudinally over the rod to carry the drapes between open and closed positions. The intermediate support for the rod interferes with this longitudinal movement of the hanger along the rod. Certain expedients had been previously proposed to facilitate the movement of hooks or hangers relative to a supporting rod where the rod enjoys intermediate support. These include, for example, Bradley U.S. Pat. No. 2,538,755 (rotatable rod supported from below by bearings mounted in a support bracket, and curtain hooks engaging the top side of the rotatable rod through bias mounted rollers so that the curtain hooks are driven laterally of the rod as the rod rotates), and Bradley U.S. Pat. No. 2,741,923 (curtain rod suspended from above on hangers and "C" shaped bearing mounted curtain hooks traversably mounted open mouth up on the curtain rod). Silverman U.S. Pat. No. 2,320,308 proposes a sliding shower curtain hook on a rod, but shower curtains are generally short enough that the rod does not require the provision of any intermediate support. Where ornamental rods, particularly round rods, are employed to moveably support drapes, typical support systems employ torus shaped rings that fully encircle and slide over the rod. The drapes are hung from the lower sides of the rings. The intermediate rod supports prevent these rings from sliding axially of the rod past its midpoint mounting. The prior art devices and methods are not without their shortcomings. A major shortcoming of typical prior art devices and methods is that the structures were complicated and therefore expensive and difficult to make and install. For example, the provision and mounting of bearings on the hooks and rods greatly complicated the prior devices. The proposed expedients for mounting the rods were complicated and expensive to make, and required considerable skill and time to mount. The prior proposed expedients were prone to failure. For example, the failure of just one of a dozen or more bearings rendered the whole system inoperable. The expense associated with the production, installation, and maintenance of the prior art devices foreclosed their usage in many markets.

These and other difficulties of the prior art have been overcome according to the present invention.

BRIEF SUMMARY OF THE INVENTION

The present invention has been developed in response to the current state of the art, and in particular, in response to these and other problems and needs that have not been fully or completely solved by prior proposed expedients. Thus, it is an overall object of the present invention to effectively resolve at least the problems and shortcomings identified herein. In particular, it is an object of the present invention to provide a drapery mounting system that is simple, rugged, inexpensive and easy to install, and virtually maintenance free. It is also an object of the present invention to provide such a system wherein the rod is retained in a saddle. Finally, it is an object of the present invention to provide such a system wherein the rod mounting saddle and associated support arm are configured to facilitate the direct mounting to and sliding of the drapery hooks over it.

A preferred embodiment of the drapery mounting system according to the present invention comprises a drapery rod member, a drapery hanger element, and a support member for the rod. The support member includes a saddle, a support arm, and a retainer. The support member is positioned below and intermediate the respective opposed ends of the drapery rod. The saddle is shaped to support a lower external portion of said drapery rod. The saddle supports the rod and the retainer releasably retains the drapery rod in engagement with the saddle. The functions of support and retention are separated to facilitate the unimpeded longitudinal movement of the drapery hanger over the full length of and directly on the rod. The saddle extends laterally of the drapery rod for less than about the cross-sectional width of the rod to permit a drapery hanger to pass unimpeded over the saddle. The saddle element preferably has longitudinally opposed edges disposed along the drapery rod. The longitudinally opposed edges are preferably generally convexly arcuate relative to a longitudinal axis of the drapery rod. A support arm supports the saddle from below. The drapery hanger is directly and slidably supported on the drapery rod member for substantially unimpeded movement past the support member. The drapery hanger typically has, for example, a generally question mark shaped form including a hook portion with an open mouth and a depending leg portion, with the open mouth preferably being of sufficient width to pass the drapery rod member laterally therethrough. The depending leg is configured to mount and support a drape. The hook portion directly engages the rod.

To acquaint persons skilled in the pertinent arts most closely related to the present invention, a preferred embodiment of a drapery mounting system that illustrates the best mode now contemplated for putting the invention into practice is described herein by, and with reference to, the annexed drawings that form a part of the specification. The exemplary drapery mounting system is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum of drapery mounting systems. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation.

DETAILED DESCRIPTION OF THE PREFERRED EMBODIMENTS

Figure 1:
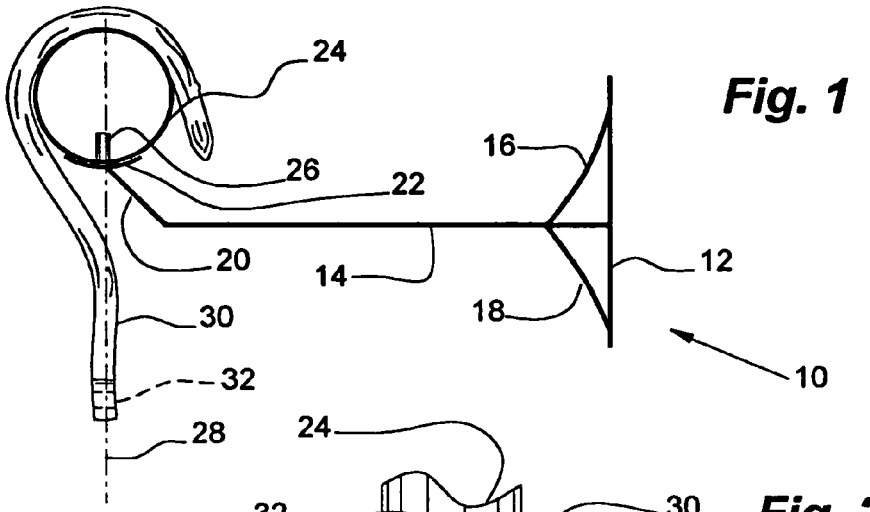
FIG. 1 is a side elevational view of a preferred embodiment of the invention wherein a drapery rod is supported and removably retained in a saddle, and a freely slidable question mark shaped hanger is directly mounted on the rod.
Figure 2:
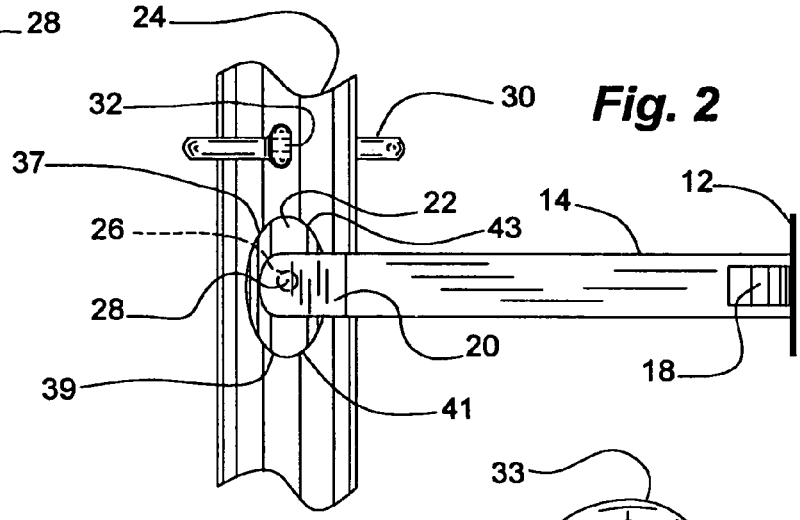
FIG. 2 is a bottom view of the embodiment of FIG. 1.
Figure 3:
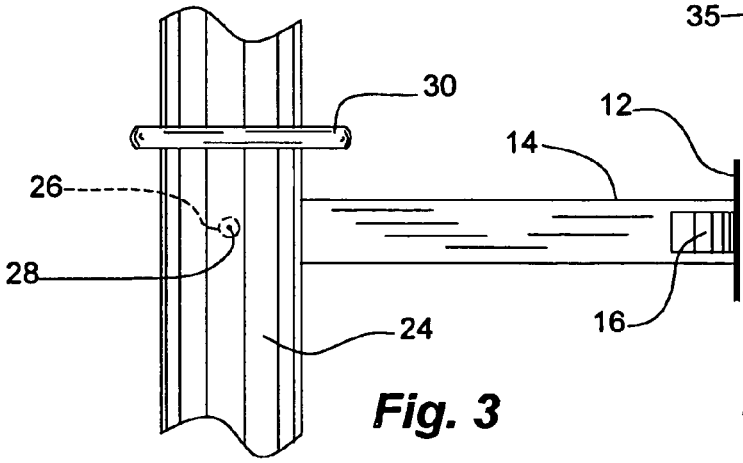
FIG. 3 is a top view of the embodiment of FIG. 1.
Figure 12:
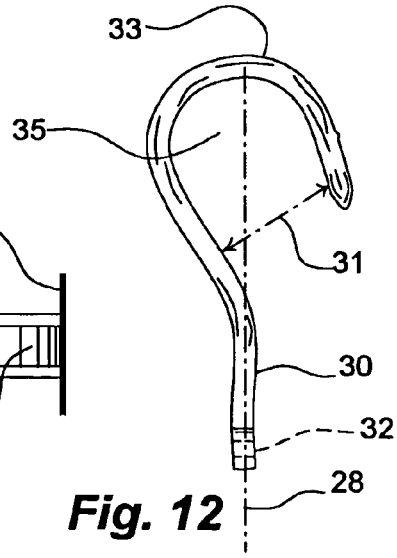
FIG. 12 is an elevational view of the drapery hanger illustrated in FIG. 1

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Referring particularly to the drawings, there is illustrated generally at 10 a drapery mounting system that includes a mounting plate 12, support arm 14, and arm braces 16 and 18 that hold support arm 14 in a substantially rigid configuration with plate 12. In this preferred embodiment support 14 includes an extremity that projects angularly upwardly and is supportingly affixed, for example, by welding, to a saddle element 22. A retainer element in the form of pin 26 is affixed to and projects generally upwardly from saddle element 22. A generally round drapery rod member 24 is adapted to be supported by saddle 22. Saddle element 22 engages a lower exterior portion of drapery rod member 24. Saddle element 22 serves to support the drapery rod 24, but it does not serve to retain it against being accidentally dislodged. The draper rod is retained against accidental dislodgment by retainer 26. Retainer 26 is releasably received in an opening in a lower portion of rod 24. Disengaging rod 24 from retainer 26 requires that the rod be moved upwardly away from saddle 22 for a distance equal to the axial length of pin 26. The non-retentive support provided by saddle 22 holds the rod against the pull of gravity, but generally not against the application of substantial lateral forces, particularly when applied with some upwardly directed vector. The saddle preferably conforms to the lower external portion of the rod to stabilize the rod but not to prevent it from being moved laterally upwardly for the purposes of disengagement from the saddle. That is, the rod is not threaded through the saddle in such a manner that it would have to be moved longitudinally to disassociate it from the saddle. The separation of the support and retention functions permits the arrangement of the assembly so that a drapery hanger element can be applied by moving it laterally of the rod 24 at substantially any location along the rod's length. The drapery hanger element, even though mounted directly on the rod, can be slidably moved along the rod past the support arm and the saddle without hanging up on either. To this end the drapery hanger, in the embodiment chosen for illustration (FIGS. 1, 2, 3, 5, and 12), comprises an open mouthed hook portion 33 with an open mouth region 31. The region 35 within the hook portion 33 is adapted to directly slidably engage rod 24. That is, there are no carriage members between region 35 and rod 24. Open mouth 31 is adapted to allowing rod 24 to pass laterally therethrough into region 35. Leg 30 depends from hook portion 33 and is adapted to receive a drapery mounting member in a lateral opening 32. Although The drapery hanger can be dislodged from rod 24 by lateral movement relative to a longitudinal axis of the rod so that the rod passes out through open mouth, the weight of the drapery depending from leg 30 tends to hold the drapery hanger on the rod. When such disengagement is desired, it is a simple matter to lift the drapery hanger laterally away form the rod. The saddle 22 extends circumferentially around a lower portion of rod 24 just far enough to support the rod against gravity. The permissible circumferential extent of saddle 22 depends in part on the shape of the drapery hanger. The drapery hanger is preferably of such a size and form that it does not encounter the saddle or the support arm as it slides along the rod. The open mouth should slide longitudinally of the rod past the saddle and support arm. In some configurations because of the way a drapery is mounted or because the drapery is pulled somewhat laterally of the rod, the drapery hanger rotates around the rod and the axis 28 of the drapery hanger is tipped away form normal with the horizon. To accommodate this aberration the support arm preferably extends through approximately where the middle of the open mouth is with the axis 28 positioned normal to the horizon. Also, the opposed longitudinal extremities 37, 39, and 43, 41, respectively, of saddle 22 are arcuately convex relative to a longitudinal axis of the rod. Thus, if a drapery hanger is moved so far out of its normal position that it does touch the saddle, it will slide over the saddle without hanging up. Preferably, in the embodiment chosen for illustration, the normally vertical axis 28 of the drapery hanger extends through retainer pin 26 and leg 30 so that the weight of the drapery tends to prevent the rod from becoming accidentally dislodged from the rod 24. As will readily occur to those skilled from these teachings, other arrangements and configurations are satisfactory.

Figure 4:
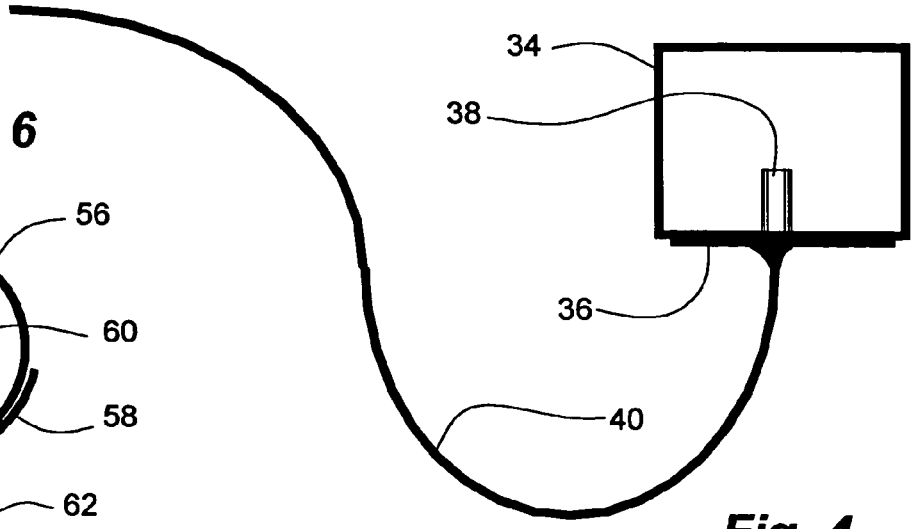
FIG. 4 is a partial side elevational view of a further preferred embodiment wherein the rod is square and the saddle upon which it is releasably retained presents a generally flat supporting surface for the rod.

With particular reference to the embodiment of FIG. 4, a preferred embodiment is disclosed wherein a rectangular rod 34 is supported on its generally lower planar surface by a saddle 36 that has an upwardly facing generally planar surface. The supporting facial surface of the planar saddle extends no further than approximately equal with the width of the rod 34. Pin 38 is engaged in a hole in the lower planar wall of rod 34 to retain the rod in engagement with saddle 36. Support arm 40 holds saddle 36 in position.

Figure 6:
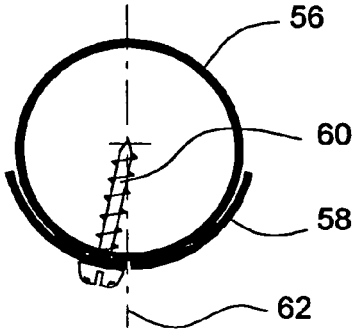
FIG. 6 is a side elevational view of a further preferred embodiment of a rod-saddle-retainer system according to the present invention.
Figure 7:
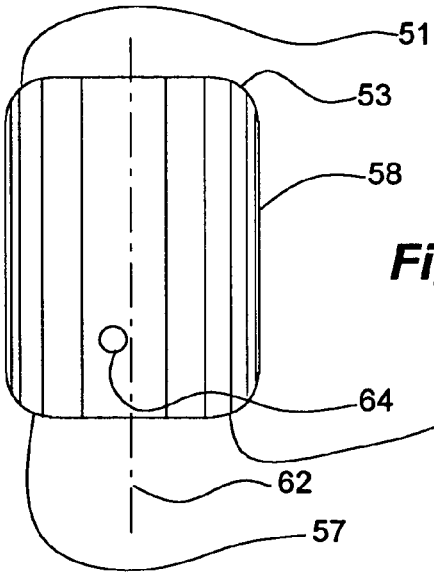
FIG. 7 is a bottom view of the saddle depicted in FIG. 6.

With particular reference to FIGS. 6 and 7, a preferred embodiment is illustrated wherein a saddle 58 supportingly conforms to less than approximately the bottom half of the circumference of rod 56, and the retention function is provided by threaded fastener 60. Fastener 60 is inserted through hole 64 in saddle 58 at a location that is convenient for installation and aesthetic purposes. Since there is a positive engagement and holding by the fastener of the rod to the saddle, it need not fall on a vertical axis of the system or on longitudinal axis 62 of saddle 58. More than one fastener or a combination of fasteners and pins can be employed, if desired. Saddle 58 extends laterally for almost the cross-sectional width of rod 56. If it were to extend conformingly for more than this cross-sectional width, the rod would have to be threaded longitudinally into the saddle. Also, there would very likely be some interference between the support member and any drapery hanger mounted thereon. The longitudinally opposed edges, 53, 55, and 51, 57 of saddle 58 are arcuately convex along longitudinal axis 62 so as to not obstruct the longitudinal sliding of a drapery hanger along rod 56.

Figure 5:
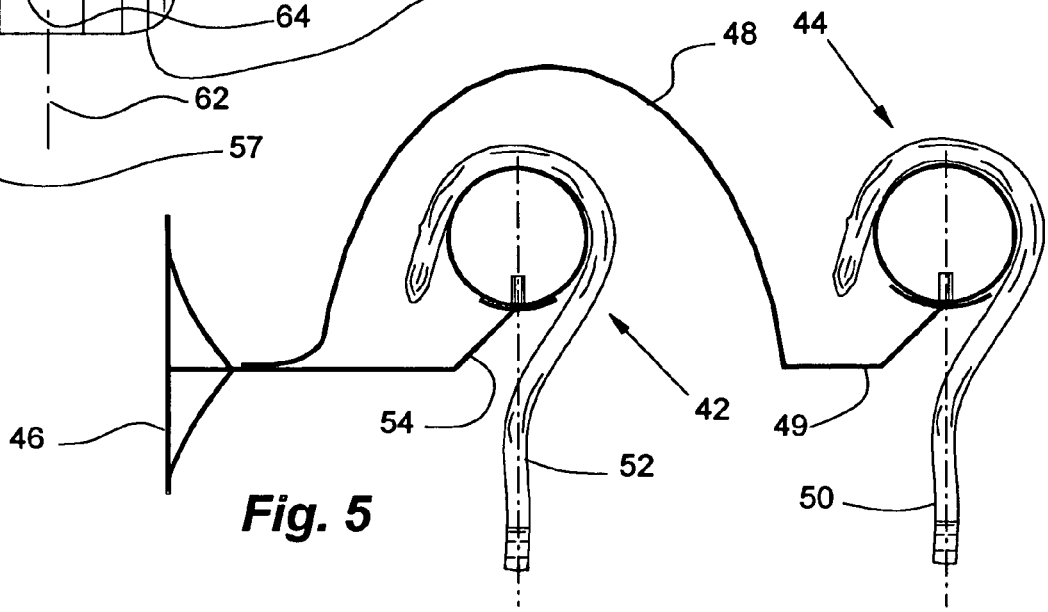
FIG. 5 is a side elevational view of an additional preferred embodiment wherein two generally parallel rods are removably support from below in saddles, and drapery hangers are freely slidably mounted directly on the respective rods.

With particular reference to the preferred embodiment of FIG. 5, a double system with a first drapery mounting system 42 in tandem with a second drapery mounting system 44 is illustrated. Wall plate 46 holds both systems in place. Support arm 54 holds system 42, and support arm 49 holds system 44. Support arm 49 is mounted to support member 48 that arches over system 42. Support member 48 serves to support system 44 and as a hood for system 42. Support member 48 prevents drapery hanger 52, in the region of support system 42, from moving far enough laterally to disengage from the rod.

Figure 8:
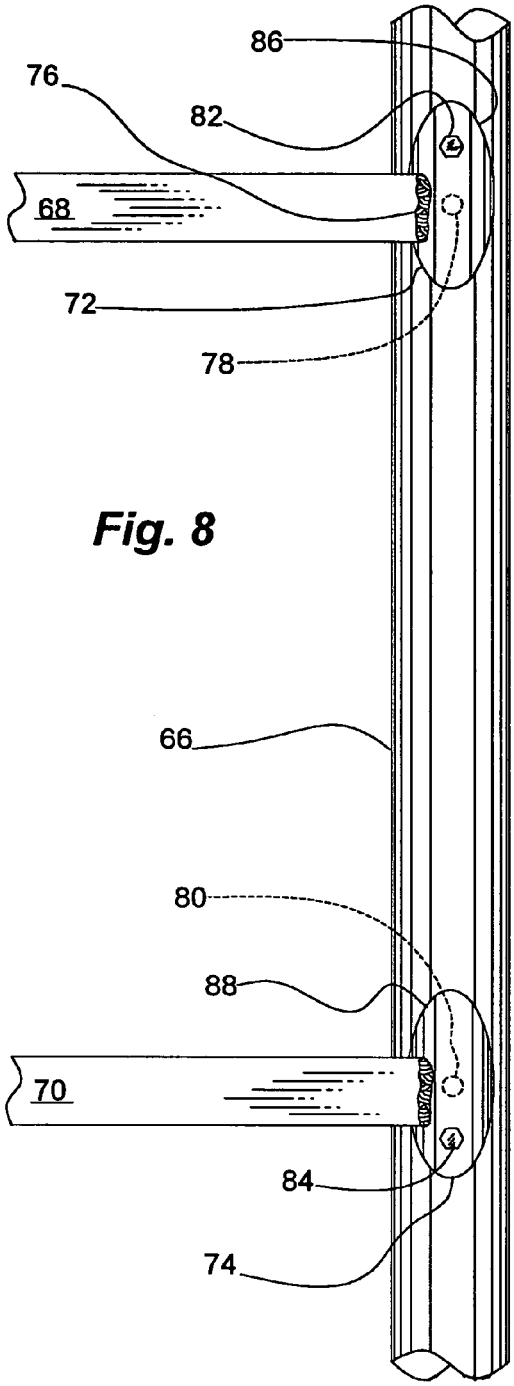
FIG. 8 is a bottom view of a preferred embodiment as installed with a plurality of supporting members removably supporting a drapery rod intermediate its ends in a plurality of specially shaped saddles.

With particular reference to FIG. 8, a preferred embodiment is illustrated wherein a plurality of support members are disposed intermediate the opposed ends of rod 66. Support arm 68 is welded at 76 to a saddle. A retainer pin 78 is fixed to and projects normally upwardly from the saddle into engagement with a mating hole in rod 66. A threaded fastener 82 also further retains the rod 66 operably engaged with the saddle. The longitudinally opposed ends 72, 86 of the saddle are arcuately convex relative to a longitudinal axis of the rod 66 and the saddle. Likewise support arm 70 is welded to a saddle from which a retainer pin 80 projects, and threaded fastener 84 further retains the rod 66 in engagement with the saddle. The saddle and retainer can be integral with one another, or separate, as may be desired. The longitudinally opposed edges 74 and 80 of the saddle are arcuatly convex relative to the longitudinal axis along which a drapery hanger mounted on rod 66 would slide.

Figure 10:
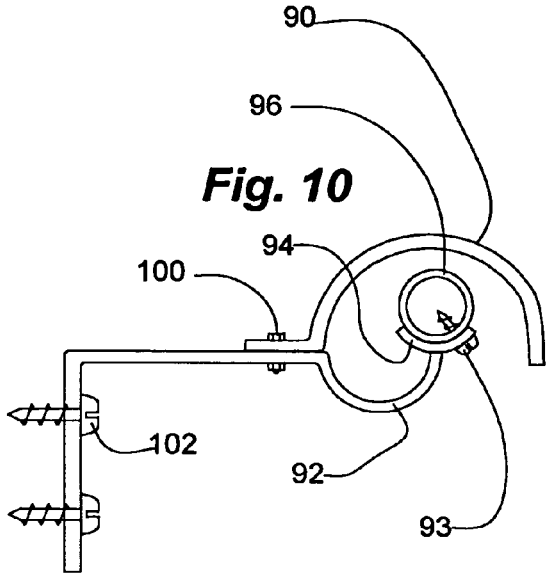
FIG. 10 is a side elevational view similar to FIG. 9 except that the retainer is in the form of a threaded fastener.
Figure 9:
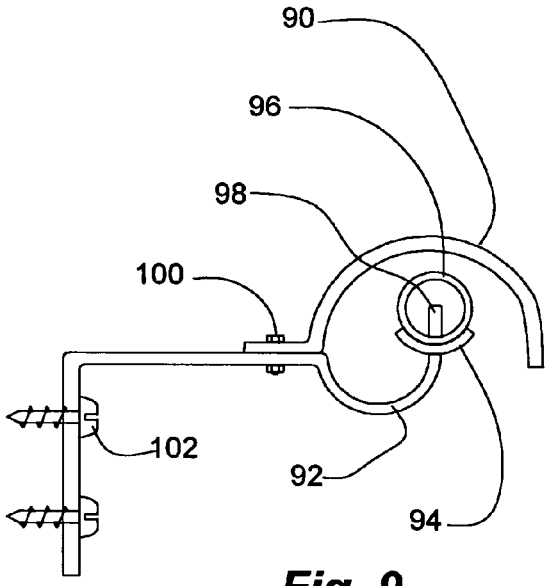
FIG. 9 is a side elevational view of a preferred embodiment wherein a hood is provided over the saddle region for decorative purposes and also to prevent the hanger from being dislodged upwardly, and a pin retainer engaged with the rod.
Figure 11:
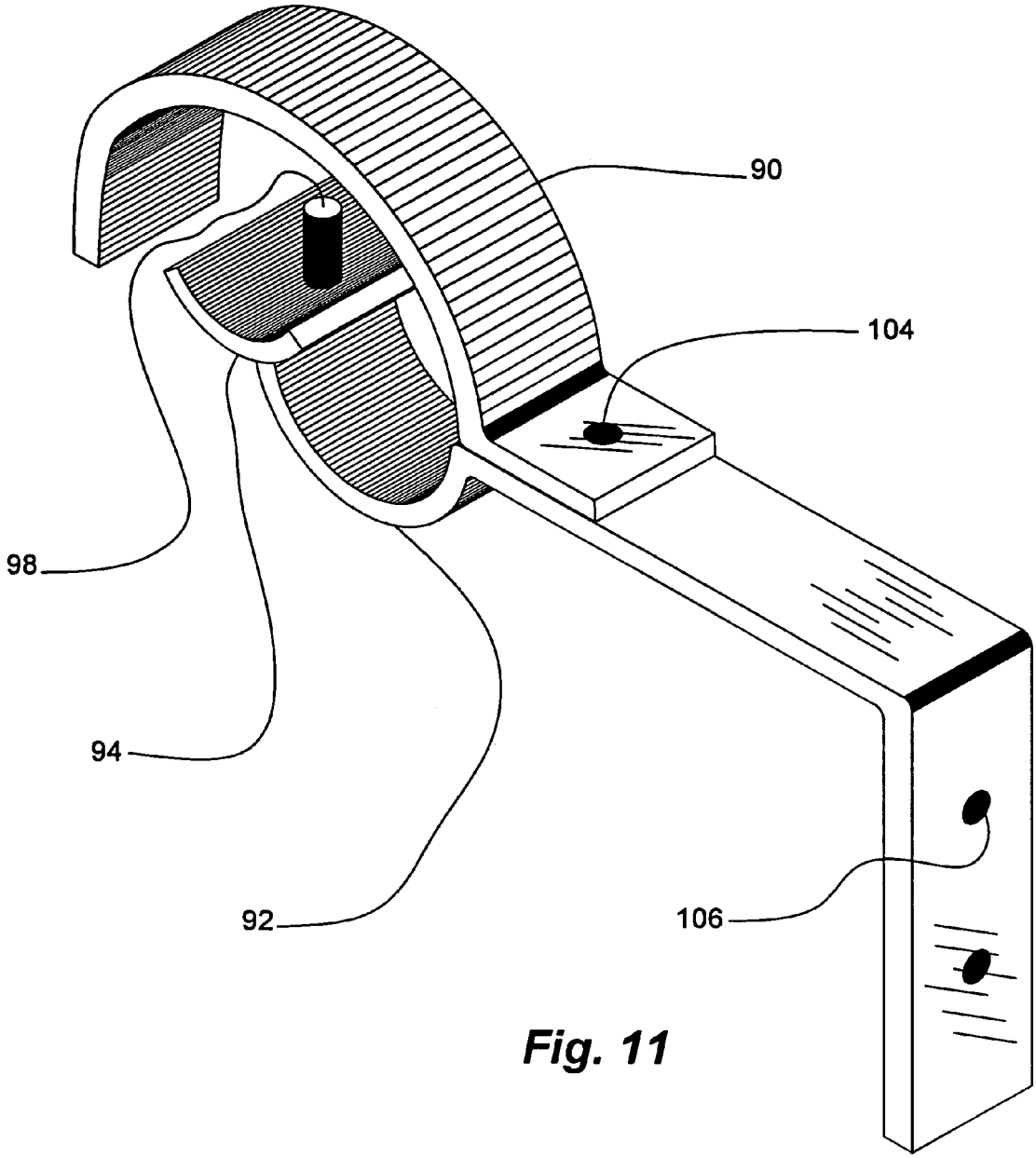
FIG. 11 is an isometric view of the embodiment of FIG. 9 from which the rod has been removed to permit a clearer view of the saddle-retainer features.

With particular reference to FIGS. 9, 10, and 11, a preferred embodiment is illustrated in which a rod 96 is retained in a saddle 94 by either a pin 98 (FIG. 9) or a threaded fastener 93 (FIG. 10). A hood 90 is provided to prevent a drapery hanger from being dislodged from engagement with rod 96 in the region of the support member. Arm 92 serves to support Saddle 94. Hood 90 is illustrated as being mounted on arm 92 by way of a nut and bolt 100 through hole 104. Other forms of fastening, such as, for example, welding or the like would serve as well. Likewise, screw 102 through hole 106 is illustrated as mounting the assembly to a wall although other forms of mounting to a supporting structure, such as, for example, adhesive, or the like would serve as well. The saddle 94 is illustrated in FIG. 11 as having square corners on longitudinally opposed ends. This illustrates why sharp corners on the saddle might cause a drapery hanger to hang up as it passes over them, and is a usable although generally less preferred form of the invention.

The saddles are conveniently manufactured, for example, by forming round disks from flat metal stock and then bending them until they generally conform to the shape of the rod they are intended to support. The saddles should generally extend for less than one half of the circumference of the associated rod so that the rod can be disengaged from the saddle by lateral movement. Where the rod is rectangular the saddle can generally extend for more than one-half of the circumference without causing the drapery hanger element to hang on it. Such forms of the saddle are encompassed within the present invention. Reducing the circumferential extent of the saddle to less than three-eighths, or one-third, or even one quarter of the circumference of the rod leaves the supporting function of the saddle unimpaired, and minimizes the risk of interference between the drapery hanger and the support member. The aesthetics of the system are also generally improved by minimizing the circumferential extent of the saddle. The hood elements, when present, serve to conceal the support members, thus improving the aesthetic aspects of the invention.

The drapery mounting system according to the present invention consists of simple components that are easy to make and install, and which require no maintenance. When disassembly is required, it is easily accomplished without the use of other than conventional and readily available hand tools. Where a retainer pin is used without a threaded fastener, no tools are required. Two simple retention mechanisms have been illustrated, but other mounting devices will occur to those skilled in the art from a consideration of these teachings. Various rod forms have been illustrated. Other forms are readily available and as will be appreciated by those skilled in the art, these other forms are usable following the teachings of the present invention. The rods can be, for example, arcuate along a longitudinal axis, and oval or otherwise in cross-section, and the like.

As will be understood by those skilled in the art, various saddle forms are suitable for use according to the present invention. In the embodiments chosen for the purposes of illustration, the saddle elements generally have some significant lateral and longitudinal extent so as to provide an area of contact with the rod. This is not necessary. Saddle elements that make no more than point or line contact with the rod member serve the necessary support function, but are less preferred. Thus, for example, the upper end of arm 92, without saddle element 94, would make line contact with the rod and serve to support the rod in place. In general, a saddle element that makes only point or line contact is less preferred because the engagement is not so secure and it may feel wobbly or unstable to the user unless two or more line or point contacts are provided.

The support mechanism is external to the rod. Thus, no complicated assembly to the rod is required. At most, the drilling of a hole to accept a retainer element is required on the part of the installer. The drapery hanger is permitted to slide unimpeded from one end of the rod to the other although the rod may be supported at several intermediate locations between the opposed ends of the rod. The form of the drapery hanger is such that it will slide substantially unimpeded past the support arm and saddle. Preferably, but not necessarily, for purposes of quickly and easily removing and installing drapery, the form of the drapery hanger is such that it can be removed laterally from the rod. Other than that, the form of the drapery hanger is not limited. The material of construction is typically metal because of its durability, although durable plastics can be used, if desired.

Typically, during installation, the support members are mounted to a wall, and the rod is placed on the support members. Holes are drilled in the rod for the retainer elements as needed. The saddle can be pre-drilled or drilled at the same time if desired. The retainers are installed. The drapery hangers are mounted to the drapes, and the drapery hangers are preferably hung on the rods by inserting them laterally over the rods. If desired, the drapery hangers can be mounted to the rod by sliding them longitudinally from one end of the rod. No drapery traversing mechanism is used because,. without more, the drapery hangers will slide in direct contact with and longitudinally of the rod for the full length of the rod. End stops, typically ornamental, can be applied to prevent the drapery hangers from sliding off the ends of the rod.

What have been described are preferred embodiments in which modifications and changes may be made without departing from the spirit and scope of the accompanying claims. Many modifications and variations of the present invention are possible in light of the-above teachings. It is therefore to be understood that, within the scope of the appended claims, the invention may be practiced otherwise than as specifically described.

What is claimed is:

1. A drapery mounting system comprising:

a drapery rod support member adapted to being supportingly positioned below and intermediate opposed ends of a drapery rod member that has a cross-sectional width and a circumference, said drapery rod support member including a saddle element and a retainer element, said saddle element being adapted to generally supporting said drapery rod member from below and to extend circumferentially of said drapery rod member for no more than approximately one half said circumference, said retainer element being adapted to releasably retaining said drapery rod member in engagement with said saddle element;

a drapery hanger element, said drapery hanger element including an open mouthed hook portion having a drapery rod member engagement portion, said open mouthed hook portion having an open mouth that is at least as wide as said cross-sectional width, said drapery rod member engagement portion being adapted to being directly and slidably received on an external upper portion of said drapery rod member for substantially unimpeded sliding movement directly on said external upper portion of said drapery rod member past said drapery rod support member; and, a hood element adapted to extending generally above and out of contact with said drapery rod member adjacent said saddle element, said hood element being adapted to preventing said drapery hanger element from disengaging from said drapery rod member as said drapery rod member engagement portion moves on said drapery rod member past said saddle element.

2. A drapery mounting system of claim 1 wherein said drapery hanger element has a generally question mark shaped form.

3. A drapery mounting system of claim 1 wherein said retainer element comprises a pin mounted to and projecting upwardly from said saddle and adapted to engage an opening in said lower exterior portion.

4. A drapery mounting system of claim 1 wherein said retainer element comprises a threaded fastener retaining said drapery rod member in engaged supported relationship with said saddle element.

5. A drapery mounting system of claim 1 wherein said saddle element is adapted to extending circumferentially of said drapery rod member for no more than about three eighths of said circumference.

6. A drapery mounting system of claim 1 wherein said saddle element is adapted to extending circumferentially of said drapery rod member for no more than about one third of said circumference.

7. A drapery mounting system of claim 1 wherein opposed longitudinal extremities of said saddle element are bounded by generally convex arcuate edges.

* * * * *